United States Patent [19]

Dupre

[11] 4,199,103

[45] Apr. 22, 1980

[54] ADJUSTABLE SNOW MAKING TOWER

[76] Inventor: Herman K. Dupre, Seven Springs, Champion, Pa. 15622

[21] Appl. No.: 3,627

[22] Filed: Jan. 15, 1979

[51] Int. Cl.[2] ..... A01G 15/00

[52] U.S. Cl. ..... 239/14; 239/276; 239/280

[58] Field of Search ..... 239/2.5, 14, 276, 280, 239/280.5, 281; 248/219.1, 218.4, 219.2, 219.3, 219.4; 137/615

[56] References Cited

U.S. PATENT DOCUMENTS

| | | | |
|---|---|---|---|
| 3,706,414 | 12/1972 | Dupre | 239/14 |
| 3,814,319 | 6/1974 | Loomis | 239/14 |
| 3,822,825 | 7/1974 | Dupre | 239/14 |
| 4,060,282 | 11/1977 | Kehr | 137/615 X |

*Primary Examiner*—John J. Love

*Attorney, Agent, or Firm*—Carothers and Carothers

[57] ABSTRACT

An adjustable snow making tower wherein the placement of manufactured snow on ski slopes may be regulated. The tower comprises a support pole having the bottom end anchored in the ground and an elongated conduit having air and water supply lines connected to the bottom thereof and air and water discharge nozzle means at the top thereof which is provided to make snow in freezing ambient temperatures. The bottom of this conduit is pivotally connected to the support pole adjacent to the bottom thereof for pivoting the conduit in a vertical plane for adjustment of snow placement on the ground surface. A slide guide is secured to the support pole adjacent the top end and is slidably engageable with the conduit to guide the pivotal movements thereof and limit the extremes of pivotal movement thereof for proper placement of manufactured snow on the ski slope, particularly in response to wind conditions.

4 Claims, 2 Drawing Figures

43
42
41
39
40
45
16
17
35
33
13
34
39
32
50
44
23
25
10
24
28
14
31
25
30
15
36
21
22
20
29
25
24
25
21
22
31
38
13
18
19
11
12
46

ADJUSTABLE SNOW MAKING TOWER

BACKGROUND OF THE INVENTION

This invention relates generally to fluid sprinkling and more particularly to snow making towers for ski slopes.

The typical snow making system for ski resorts includes a plurality of snow making towers which are positioned along the ski slope. However, placement of manufactured snow on the ski slope proper becomes very difficult under varying wind conditions. In order to compensate for this, some snow making towers may be rotated to direct the snow making spray. However, even this does not properly compensate for the many different wind variations and the snow build-up occurs at places on the ski slope where it is not needed nor desired, creating a waste. In addition, this type of snow making system of the prior art generally requires that the snow making towers be placed along the center line of the ski slope in order to build up a snow base on either side of the line of snow making towers for skiing. This, of course, creates a hazard possibility for the skiers and it is therefore preferred that the ski towers be positioned to one side or the other of the ski slopes.

A principal object of the present invention is to provide an adjustable snow making tower which will eliminate the aforementioned disadvantages and provide proper placement of the manufactured snow on the ski slope for different wind conditions.

SUMMARY OF THE INVENTION

The adjustable snow making tower of the present invention comprises a support pole having its bottom end anchored in the ground, and an elongated conduit means having air and water supply lines connected to the bottom end thereof and an air and water discharge nozzle means adjacent the top end thereof for making snow in freezing ambient temperatures. The bottom end of this conduit means is pivotally connected to the support pole adjacent the anchored bottom end thereof for pivoting of the conduit thereabout in a vertical plane for adjustment of snow placement on the ground surface. Slide guide means is secured to the support pole adjacent the top end thereof and slidably engageable with the conduit means to guide the pivoting thereof and limit the extremes of pivot of the conduit means about its lower pivot point to place the manufactured snow on the ski slope even though wind conditions might otherwise interfere if the snow tower were fixed.

A hand line is preferably secured to the upper end of the pivoted conduit adjacent the aforesaid slide guide means, and this hand line passes over a pulley secured to the upper end of the support pole and then drops downward toward the ground surface for grasping to assist in manipulation and positioning of the conduit or snow manufacturing tower over the ski slope, depending on wind conditions. A conventional cleat may be provided on the side of the support pole for tying down the hand line to position the conduit or tower as required.

The conduit is also preferably bent outwardly away from the support pole so that it extends over top of the ski trail. This further permits the ski towers to be positioned at the side of the ski trail, thereby eliminating possible ski hazards, and also permits more complete control of snow placement under varying wind conditions.

An additional feature of the present invention is that main air and water supply lines vertically extend from the ground surface adjacent the snow tower for a sufficient distance to clear expected snow build-up on the ground surface. Valves are provided at the upper ends of these supply lines respectively and connect them to flexible pipe lines to the bottom ends of the adjustable snow tower or conduit.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figures 1, 2:
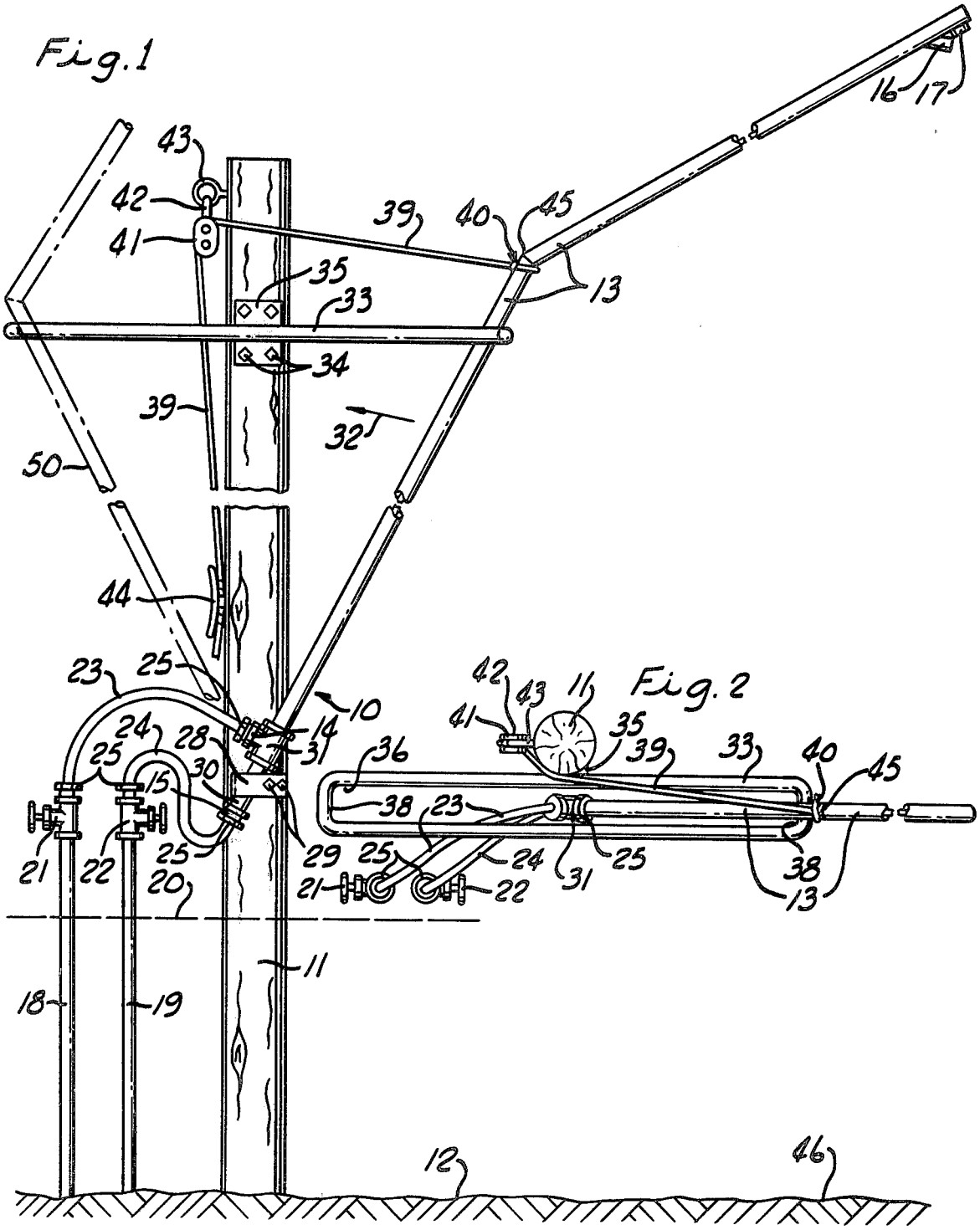
FIG. 1 is a view in side elevation of the adjustable snow making tower of the present invention with portions removed.
FIG. 2 is a plan view of the adjustable snow making tower illustrated in FIG. 1.

Referring to the figures, the adjustable snow making tower 10 of the present invention is comprised of support pole 11 (which may be a conventional wooden pole of, say, 15 to 30 feet) having its bottom end anchored in ground surface 12. An elongated conduit or conduit means 13 is provided with a water supply inlet 14 and an air supply inlet 15 at the bottom end thereof and the top of the elongated conduit or snow making tower conduit 13 is provided respectively with a water discharge nozzle 16 and an air discharge nozzle 17 for making snow in freezing ambient temperatures.

Water and air are fed respectively through main water and air supply lines 18 and 19 from underground. Air and water supply lines 18 and 19 vertically extend from ground surface 12 a sufficient distance to clear expected snow build-up on the ground surface as indicated by the dashed outline 20. The reason for this is that respective valves 21 and 22 are connected to the top of the pipelines 18 and 19 and thus eliminate digging down in the snow build-up in order to operate the valves.

Valves 21 and 22 in turn are connected to inlets 14 and 15 of the conduit means 13 by means of flexible pipe connections 23 and 24 respectively. Connection of these flexible pipe sections 23 and 64 are preferably made at both ends with conventional quick disconnect couplings 25 which do not require threading.

The snow making conduit means 13 is basically identical in function to the snow making apparatus and system discussed in my U.S. Pat. No. 3,822,825 issued July 9, 1974. However, it should be realized that any known snow making tower conduit or system may be employed within the confines of the teachings of my present invention.

The bottom end of conduit 13 is pivotally connected to support pole 11 by means of anchor strap 28. Anchor strap 28 is secured to pole 11 by means of lag screws 29 and has an outward curved portion which wraps around the bottom small diameter pipe 30 of conduit 13 with more than adequate clearance, yet is smaller in diameter than pipe Tee coupling 31 such that the bottom of coupling 31 rests upon the top of pivot strap 28. Thus, conduit 13 rests on pivot strap 28 and pivots thereabout in a vertical plane as indicated by arrow 32 for adjustment of snow placement on the ground surface or ski slope 12.

A slide guide 33 for conduit 13 is secured to support pole 11 adjacent the top end thereof by means of lag screws 34. Slide guide 33 consists of a rectangular structure as best illustrated in FIG. 2. which may be readily constructed of conventional pipe sections and welded to a base plate 35 which is, in turn, secured to the support pole 11 by means of lag screws 34. Conduit 13 is received through the slide guide slot 36 formed in slide guide 33 such that it is slidably engageable with slide guide 33 to guide the pivoting of the conduit 13 and to also limit the extremes of pivotal movement in and out of conduit tower 13 about pivot 28 by means of the end stops or limits 38.

The hand line 39 is secured to the upper end of conduit 13 adjacent slide guide 33 as indicated at 40, and passes over pulley 41, which is secured to the upper end of support pole 11, and then travels downwardly as indicated for hand grasping.

Pulley 41 has a conventional eye pivot connection 42 which is in turn passed through and retained by a conventional eye lag screw 43 received in the top of support pole 11. A conventional hand line cleat 44 is provided at the lower end of pole 11 to tie down the end of hand line 39.

Conduit 13 bends outwardly as indicated at 45 adjacent slide guide 33 in order to better position nozzles 16 and 17 over the ski trail 46 thus permitting the snow making tower 10 to be positioned to the side of the ski trail.

However, if wind conditions are such that the wind is prevailing from the left side of the snow tower as viewed in the figures, then conduit 13 may be pivoted about pivot point 28 as indicated by arrow 32 so that the main snow placement will still occur on the ski trail 46. With the hand line 39, conduit 13 may be positioned anywhere within the limits of the stops 38 of slide guide 33 and when positioned, the bottom end of hand line 39 is then tied down to cleat 44.

For example, the bottom portion of conduit 13 may be positioned exactly vertical by pulling in hand line 39 as far as possible and then tying it down. It may also be positioned past vertical by pulling it to the vertical position with hand line 39 and then giving it a small shore by hand past vertical center so that it extends to the left and ultimately to its extreme limit position as indicated by the phantom outline 50. Since pulley 41 is provided with a conventional pivot connection 42, it may rotate thereabout as conduit 13 passes pulley 41. It is thus seen that conduit 13 may be held in position anywhere along its pivotal path of travel guided by slide guide 33 by tying off the end of hand line 39.

I claim:

1. An adjustable snow making tower comprising, a support pole having a bottom end anchored in a ground surface, elongated conduit means having air and water supply lines connected to one end thereof designated the bottom and air and water discharge nozzle means adjacent the top thereof for making snow in freezing ambient temperatures, the bottom end of said conduit means pivotally connected to said support pole adjacent the anchored bottom end thereof for pivoting of said conduit means thereabout in a vertical plane for adjustment of snow placement on the ground surface, and slide guide means secured to said support pole adjacent the top end thereof and slidably engageable with said conduit means to guide the pivoting of and limit the extent of pivot of said conduit means about said pivot.

2. The adjustable snow making tower of claim 1, said slide guide means also including a hand line secured to the upper end of said conduit means adjacent said slide guide means and passing over a pxlley secured to the upper end of said support pole and then downward toward the ground surface for grasping to assist in manipulating and positioning said conduit means along said slide guide means.

3. The adjustable snow making tower of claim 1 wherein said conduit means bends outwardly adjacent said slide guide means.

4. The adjustable snow making tower of claim 1 including main air and water supply lines vertically extending from the ground surface a sufficient distance to clear expected snow build-up on the ground surface and respective valves at the upper ends of said supply lines respectively connecting them to said air and water supply lines feeding said conduit means.

* * * * *